United States Patent [19]

Grip et al.

[11] Patent Number: 4,575,912

[45] Date of Patent: Mar. 18, 1986

[54] SPRING STEEL

[75] Inventors: Carl E. Grip; Bertil J. Hagstad; Björn H. Andersson, all of Luleå, Sweden

[73] Assignee: SSAB Svenskt Stål AB, Stockholm, Sweden

[21] Appl. No.: 610,289

[22] PCT Filed: Sep. 5, 1983

[86] PCT No.: PCT/SE83/00310

§ 371 Date: May 7, 1984

§ 102(e) Date: May 7, 1984

[87] PCT Pub. No.: WO84/00981

PCT Pub. Date: Mar. 15, 1984

[51] Int. Cl.[4] ..... B23P 13/00

[52] U.S. Cl. ..... 29/173; 29/527.6; 29/527.7; 164/473; 164/476; 267/47; 148/36

[58] Field of Search ..... 148/2, 35, 36; 75/49, 75/58, 53, 123 B; 267/47; 29/173, 527.5, 527.6, 527.7; 164/476, 473

[56] References Cited

U.S. PATENT DOCUMENTS 2,861,908 11/1958 Mickelson et al. ..... 75/58

4,251,268 2/1981 Willim ..... 75/58

OTHER PUBLICATIONS

Anderson, W. S., "Calcium Silicide–A New Deoxidizing Agent", *Raw Material,* Feb. 1921, pp. 51–52.

*Primary Examiner*—L. Dewayne Rutledge

*Assistant Examiner*—Deborah Yee

*Attorney, Agent, or Firm*—Watson, Cole, Grindle & Watson

[57] ABSTRACT

The invention relates to a steel and a process for its manufacture which is suitable for the production of springs, especially leafsprings for vehicles. The steel which is vacuum-treated is an ordinary low-carbon steel with 0.20–0.40% C. Its composition is incidentally characterized in that the oxygen content does not exceed 0.040% and in that boron is added to an amount of 0.002–0.004% and titanium to an amount of 0.015–0.050%. The addition of boron causes the hardenability to increase greatly, thus making it possible to keep the carbon content low and, in consequence, reducing the danger of destructive decarbonization.

A characteristic of the process of production consists in the fact that the steel is produced in an oxygen converter in such a manner that the nitrogen content in the ladle does not exceed 20 ppm, in that it is subsequently subjected to vacuum treatment and in that Al is added so that the amount of uncombined oxygen drops to max. 40 ppm, whereafter titanium and boron are added prior to continuous casting and rolling.

2 Claims, No Drawings

SPRING STEEL

TECHNICAL SCOPE

The invention relates to a steel and to the process for its production, this steel being suitable for the production of springs, especially leafsprings for vehicles, characterised above all in that it is an easily workable carbon steel with low carbon content and an addition of boron for improved full hardening and for making the steel self-tempering.

TECHNICAL BACKGROUND

In order to attenuate in particular impact forces in vehicles use is made of springy arrangements such as for instance helical springs and leafsprings. Helical springs are most commonly made of round material and the resilient properties of the steel from which they are made are achieved above all by cold working such as drawing of the material. For vehicles the wheels of which are subject to low loads these helical springs are well suited. As regards heavier vehicles use is made of springs having a largercross-sectional area such as leafsprings of various designs. Apart from many other advantages it is a characteristic of the leafsprings that their stability in other directions of motion than the one in which the spring is intended to act is high.

Since the moment of forces acting on leafsprings is greatest at their centre, that is where one provides the largest cross-sectional area. This can be done in different ways. One can make the spring leaf widest at the centre and tapering towards the ends. This spring design is space-consuming and entails great losses of material in the process of manufacture. The spring leaf can be made thicker at the centre. Such springs are often referred to as parabolic leafsprings and have recently been gaining in importance. Parabolic leafsprings require relatively little space but on the other hand their production is costly. The most common type of leafsprings is the so-called laminated leafspring and above all the type produced from flat bars, which are cut to different lengths and stacked on top of one another. The top leaf is longest and has fastening eyes at the ends. The length of the leaf is then reduced towards the centre, and the leaf package is held together on the one hand by means of a pin passing through the centre and on the other hand by a number of yokes placed about the package between the centre and the fastening eyes. These springs are cheapest from the point of view of production. Owing to the mutual friction between the leaves the spring action is also subject to hysteresis, which causes the motion of the spring to be attenuated.

A good product for the production of springs has to satisfy stringent requirements of repeatability in order to avoid a lack of symmetry in the spring action. Apart from small dimensional variation also the variation in the characteristics of the steel should be small.

The most important characteristics of steel used for springs are a high elastic limit and a high fatigue limit.

The energy storing capacity of the spring material is proportional to the square of the elastic limit ($R_E^2$). By elastic limit is meant the maximum specific loading to which the material can be exposed for its return to the initial position without deformation of the material. With many types of steel the values of the elastic limit and the yield stress are almost identical.

The fatigue limit follows in priciple the elastic limit but, in addition, depends above all on the structural homogeneity and the surface finish, which benefits from a smooth surface free of decarbonisation layers and defects such as slag inclusions etc.

Especially with relatively coarse types of steel use is generally made of hardening and tempering in order to increase, inter alia, the elastic limit. In this connection a full hardening steel is indicated, i.e. a steel with a composition so adjusted to the thickness of the material that quenching results in the production of martensite also at the centre of the section. After hardening the material is tempered at temperatures generally in the region of 400°–500° C. in order to achieve a certain degree of toughness. Unfortunately, however, such tempering causes the elastic limit to drop.

So far the most important means with a view to achieving a high elastic limit has consisted in producing spring steel with relatively high carbon contents. Also the hardenability increases with the carbon content.

Among the types of steel currently used for springs mention may be made of SS 2090 and SS 2230. The designations are taken from the Swedish Standard.

SS 2090 contains 0.52–0.60% C. and 1.5–2.0% Si. As a result of the high Si content the full hardening capacity is increased. However, Si used by way of alloying constituent is relatively expensive.

SS 2230 contains 0.48–0.55% C., slightly more silicium as well as 0.70–1.00% Mn, 0.90–1.20% Cr and 0.10–0.20% V. This steel is used for relatively large springs. The increased contents of silicium, manganese and chromium contribute above all to the hardenability whereas vanadium is added for grain refinement.

Owing to the alloying additives the steel is costly to produce. In addition, it is relatively difficult to work by cutting and shearing drilling or stamping operations such as the drilling of holes through the leaves in order to hold together the spring package. With both of the above types of steel there is also a danger of surface decarbonisation, reducing inter alia the fatigue limit.

SUMMARY OF THE INVENTION

It has now proved that a material for springs can be produced both cheaply and efficiently by the addition of small amounts of boron, ensuring in particular that the advantageous characteristics of boron make their mark in the steel. A great advantage of the addition of boron consists in the fact that the steel can be made self-tempering, i.e. after the hardening process it is normally unnecessary to provide for any subsequent, separate tempering process.

The invention is described more closely in the attached claims and in the following section.

DETAILED DESCRIPTION OF THE INVENTION

It has proved advantageous to choose by way of basic material for the invention an unalloyed carbon steel having the following composition:

C=0.20–0.40%
Si=0.20–0.35%
Mn=1.0–1.3%
S=max. 0.040%
P=max. 0.040%
Cr=max. 0.60% with, in addition, the normally occurring and acceptable impurities. To the steel shall also be added minor amounts of boron and possibly titanium. These amounts will be specified in greater detail below.

Boron in small amounts has a very beneficial effect in particular on the hardenability and hence of course also on the elastic limit.

In order to compare the hardenabilities of various types of steel one usually applies the following formula:

$$P_c = C + Si/30 + Mn/20 + Cu/20 + Ni/60 + Cr/20 + Mo/15 + V/10 + 5 \times B$$

where the different alloying constituents are expressed, for instance, in percentages by weight. The higher the value of $P_c$ the greater the hardenability. As can be seen the contents of carbon and in particular boron are of great importance. It has also been shown that a boron content of 0.002–0.004% is most advantageous. Higher contents may, for instance, cause the steel to become brittle during the hardening stage. In order to achieve a good spring steel $P_c$ must not vary much either within the different sections of the finished steel or within the different steel charges. A suitable $P_c$ value with spring steel would, as has been shown, amount to between 0.28 and 0.36, the variation within and between charges not exceeding 0.05.

As can be deduced from the formula the C content may also, if boron is added, be kept lower than with a conventional spring steel. This of course makes the steel cheaper, and at the same time it becomes less liable to surface decarbonisation which would cause the fatigue limit to be reduced. Furthermore, this low-carbon steel which contains boron can be easily machined by means of cutting and shearing tools even in the hot rolled and non-annealed condition, whereas a conventional spring steel must be annealed owing to the high carbon content or machined in the hot state. With soft annealing there is also an increased risk of surface decarbonisation.

The addition of boron causes the steel to be self-tempering, i.e. a toughness suitable for its use in springs is achieved directly after hardening. By way of example it may be mentioned that if the toughness value (Charpy W) is measured at room temperature it varies between 25 and 35 J. For application at low temperatures and where the requirements in respect of constant mechanical characteristics are extremely stringent, tempering at max. 300° and preferably max. 230° C. may be effected in order to increase the impact strength or homogenise the material characteristics.

It has been shown that the effectiveness of boron increases if the contents in the steel melt of in particular nitrogen and oxygen are reduced. Steel for the application is advantageously produced in an oxygen converter. The degree of blow out and the lance guilding system must however be so regulated that at the tapping stage the nitrogen content of the steel does not exceed 20 ppm. This limit of the nitrogen content is certainly too high to be acceptable, but practical factors make it impossible to make it much lower. Also the oxygen content is too high. These contents can be reduced to acceptable levels by, for instance, vacuum treatment, the addition of aluminium and the addition of titanium, before boron is added. The vacuum process enables on the one hand a low oxygen content by degassing and slag separation while at the same time making possible to apply such control methods that the absorption of nitrogen from the air is reduced to a minimum. Following vacuum deoxidation the steel is further deoxidised in the usual manner by adding aluminium so that uncombined oxygen in the melt does not exceed 40 ppm and preferably 15–20 ppm. The oxygen content is limited on the one hand because uncombined oxygen has a detrimental effect on the quality of the steel, and on the other hand because the affinity of titanium to oxygen is higher than its affinity to the residual nitrogen, which it is intended to bind.

Boron is highly reactive to nitrogen, and whatever process is applied, we always find a certain residue of nitrogen. Now titanium is added in order to render such nitrogen as occurs in the melt as harmless as possible by causing it to combine so as to give rise to titanium nitride. The addition of titanium to an extent of 0.015–0.050% by weight has proved suitable, the most advantageous range being 0.020–0.045.

Experience has shown that with a spring steel in accordance with the invention the product of nitrogen content and titanium content measured in percent by weight of the melt ($Ti \times N$) should preferably be less than $4 \times 10^{-4}$. It is even more reliable to determine the amount of titanium to be added to the melt if this relationship is taken into account.

A disadvantage consists in the fact that titanium nitrides formed with this process constitute inclusions which may affect the characteristics of the steel, inter alia as regards cuttability and fatigue strength.

In order to avoid this secondary effect the nitrogen content of the steel should be as low as possible.

Following the vacuum treatment the steel is cast preferably in a continuous casting plant using the method of protected casting, i.e. with the aid of ceramic protective pipes to surround the stream or subject to the provision of another protective means about the casting streams, where the steel passes through air. In this way direct contact between steel and air is avoided, which may cause nitrogen and oxygen to be absorbed. If necessary use is made of a protective atmosphere.

Reduction rolling, from the cast melt to the finally rolled product, is also of great importance especially as regards the fatigue limit of a spring steel. The total cross sectional area must be reduced by not less than 22:1, and should be reduced by at least 25:1 in order to obtain a well processed steel.

Incidentally, the slag residues still left over in the steel may after rolling be deformed to such a shape as to exert a negative effect on the fatigue and strength characteristics. So as to avoid this contingency, the melt may be pretreated with metallic calcium by blowing powder into the melt, especially in the form of so-called silicium-calcium containing at least 20% by weight of metallic calcium. This is best done prior to the vacuum treatment. This results on the one hand in the amount of sulphide slags in the steel being reduced to a minimum and on the other hand in the remaining sulphide slags being modified after rolling to a less dangerous, round shape. The disadvantage consists in the fact that this process may lead to an increased content of nitrogen. This can however be avoided by ingenious means during the steel production process, e.g. by the use of argon by way of carrier gas when blowing in the calcium-containing powder, as well as by ensuring that no air reaches the melt during the entire process until the steel is solidified.

We claim:

1. A method of forming a spring made of a self-tempering, low carbon steel, said method comprising the sequential steps of (1) providing in a ladle a steel melt which contains, by weight, 0.20–0.40% carbon, 0.20–0.35% silicon, 1.0–1.3% manganese, up to 0.040% sulfur, up to 0.040% phosphorus, up to 0.60% chromium, up to 20 ppm nitrogen, and oxygen, (2) vacuum treating said steel melt, (3) adding an amount of aluminum to said steel melt such that the non-combined oxygen therein is reduced to between 15–20 ppm, (4) adding an amount of titanium to said steel melt such that said steel melt contains 0.020–0.045% by weight titanium, the amount of added titanium being controlled such that the product of the titanium content in the steel melt and the nitrogen content in percent by weight does not exceed 0.0004%, (5) adding an amount of boron to said steel melt such that said steel melt contains 0.020–0.004% by weight boron, (6) continuously casting said steel melt in the absence of air to form cast steel, (7) hot rolling said cast steel such that its total cross sectional reduction is not less than 22:1 to form hot rolled steel, and (8) machining said hot rolled steel into a spring without tempering.

2. A process in accordance with claim 1, including the step of blowing silicium-calcium containing not less than 20 percent by weight of metallic calcium into the steel melt between steps (1) and 2.

* * * * *